United States Patent [19]

Alter et al.

[11] 4,080,917

[45] Mar. 28, 1978

[54] ROLLER FURLING MECHANISM

[75] Inventors: Hobart Laidlaw Alter, Capistrano Beach; Jerald Wayne Blakely, Dana Point, both of Calif.

[73] Assignee: Coast Catamaran Corporation, Irvine, Calif.

[21] Appl. No.: 792,806

[22] Filed: May 2, 1977

[51] Int. Cl.[2] ..... B63H 9/04

[52] U.S. Cl. ..... 114/106; 114/39; 114/61

[58] Field of Search ..... 114/104–107, 114/102, 39, 108, 61; 254/190 K

[56] References Cited

U.S. PATENT DOCUMENTS

| | | | |
|---|---|---|---|
| 637,619 | 11/1899 | Kimball | 114/106 |
| 3,611,969 | 10/1971 | Hood | 114/106 |
| 3,678,876 | 7/1972 | Alter | 114/102 |
| 3,749,042 | 7/1973 | Jackson | 114/106 |
| 3,800,729 | 4/1974 | Keeler | 114/106 |
| 3,958,523 | 5/1976 | Holmes et al. | 114/106 |
| 4,034,694 | 7/1977 | Dismukes | 114/106 |

FOREIGN PATENT DOCUMENTS

| | | | |
|---|---|---|---|
| 2,239,496 | 2/1974 | Germany | 114/107 |

*Primary Examiner*—Stephen G. Kunin
*Assistant Examiner*—Sherman D. Basinger

[57] ABSTRACT

The jib furling mechanism is located beneath the junction of the bridle wires which hold the forestay to permit the forward portion of the foot of the jib to extend to the bridle junction and increase jib area. The bridle wires are joined by a structural link integrally formed with the housing for the furling mechanism. This housing telescopically receives a forestay adjuster for adjusting mast rake. The jib may be lowered without removing the forestay, or it may be furled about the forestay using the furling mechanism.

8 Claims, 8 Drawing Figures

ROLLER FURLING MECHANISM

BACKGROUND AND SUMMARY

The present invention relates to a mechanism for furling a jib; and it is particularly suited for furling the jib of a catamaran sailboat.

In a catamaran sailboat of the type having separate hulls joined by a trampoline, and provided with a jib sail, the forward portion of the foot of the jib is held by a pair of bridle wires forming an inverted V and connecting the forward portion of the foot of the jib respectively to the forward portions of the hulls. In this type of structure, if it is desired to provide for furling of the jib, heretofore, the furling mechanism has been incorporated into the structure at a location between the bridle junction and the foot of the jib. This has the disadvantage of raising the front of the foot of the jib at least by a height of the furling mechanism.

Although the front of the foot of the jib may be raised only in the order of four-six inches, it nevertheless can have substantial effect on the power and control of the catamaran because effective sail area is lost at a location (along the foot of the jib) most critical to increasing power and control through the jib.

Because of the particular construction used in connecting the front of the foot of the jib to the hulls of the catamaran employing bridle wires, this "lost" effective sail area cannot be regained merely by lowering the bridle junction because as the bridle junction is lowered, an undue force is induced in the bridle wires when the jib is under sail, tending to pull the forward portions of the hulls toward each other. This not only places undue stress on the fittings, but performance and speed are reduced substantially if the hulls are not parallel to each other.

This problem, of course, is of much less consequence in the case of a mono hull sailboat, and mechanisms for furling and hoisting a jib are known in these boats, see for example U.S. Pat. No. 3,958,523.

In accordance with the present invention, the forestay is secured at its top to a halyard block by a first swivel. The top of the block is attached to a second swivel which, in turn, is secured to the mast by a wire. The luff of the jib is mounted to the forestay by means of a zippered sleeve or other means which permits it to be raised and lowered. A jib halyard extends from the head of the jib, over the block, and thence downwardly through the luff sleeve to permit the jib to be raised and lowered without detaching the forestay.

The bridle wires are joined by a link which is integral with and located above a housing for a roller furling mechanism. Thus, the link forms a structural element at the bridle junction for securing the bridle wires together, and it also serves to hold the furling mechanism beneath the bridle junction. A drum rotatably mounted in the housing telescopically receives a forestay adjuster secured to the bottom of the forestay for adjusting mast rake. Thus, the luff of the jib is permitted to extend to the bridle junction because the furling mechanism is located beneath the bridle wires. Further, the furling mechanism provides an integral structural element for joining the bridle wires as well as for connecting the jib. In addition, the jib may be raised and lowered without detaching the forestay, and the forestay may be adjusted in its attachment to the furling mechanism to adjust mast rake without affecting the vertical position of the jib.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
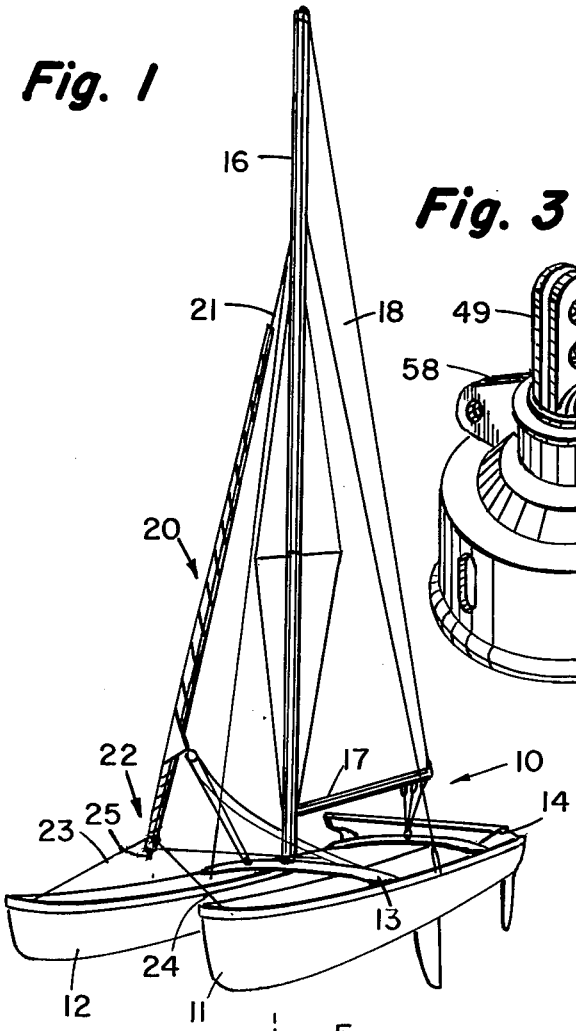
FIG. 1 is an upper forward perspective view of a catamaran sailboat incorporating the present invention with the jib furled.
Figure 3:
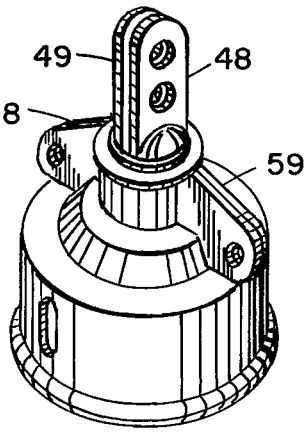
FIG. 3 is a perspective view of a housing assembly for the furling mechanism incorporated in the boat of FIG. 1.

Referring first to FIG. 1, a catamaran sailboat is generally designated by reference numeral 10; and it includes left and right hulls 11, 12 respectively. The hulls are joined together by a frame which includes a forward cross bar 13 and a rear cross bar 14 which are also adapted to support a trampoline for occupants of the boat.

A mast 16 is attached at the center of the forward cross bar 13, and a conventional boom 17 is secured to the mast 16. A mainsail 18 is attached to the mast 16 and the boom 17. Located forward of the mast 16 is a jib sail 20 (see in the unfurled or use position in FIG. 2).

As seen in FIG. 1, the jib 20 is furled about a forestay 21 which is connected between the upper portion of the mast 16 and a junction generally designated 22 between two bridle wires 23, 24. The lower ends of the bridle wires 23, 24 extend laterally and are secured by conventional means to the forward portions of the decks of the hulls 12, 11 respectively. Thus, the bridle wires form a general inverted-V shape. A furling mechanism generally designated by reference numeral 25 is located beneath the bridle junction 22.

Figures 6, 7, 8:
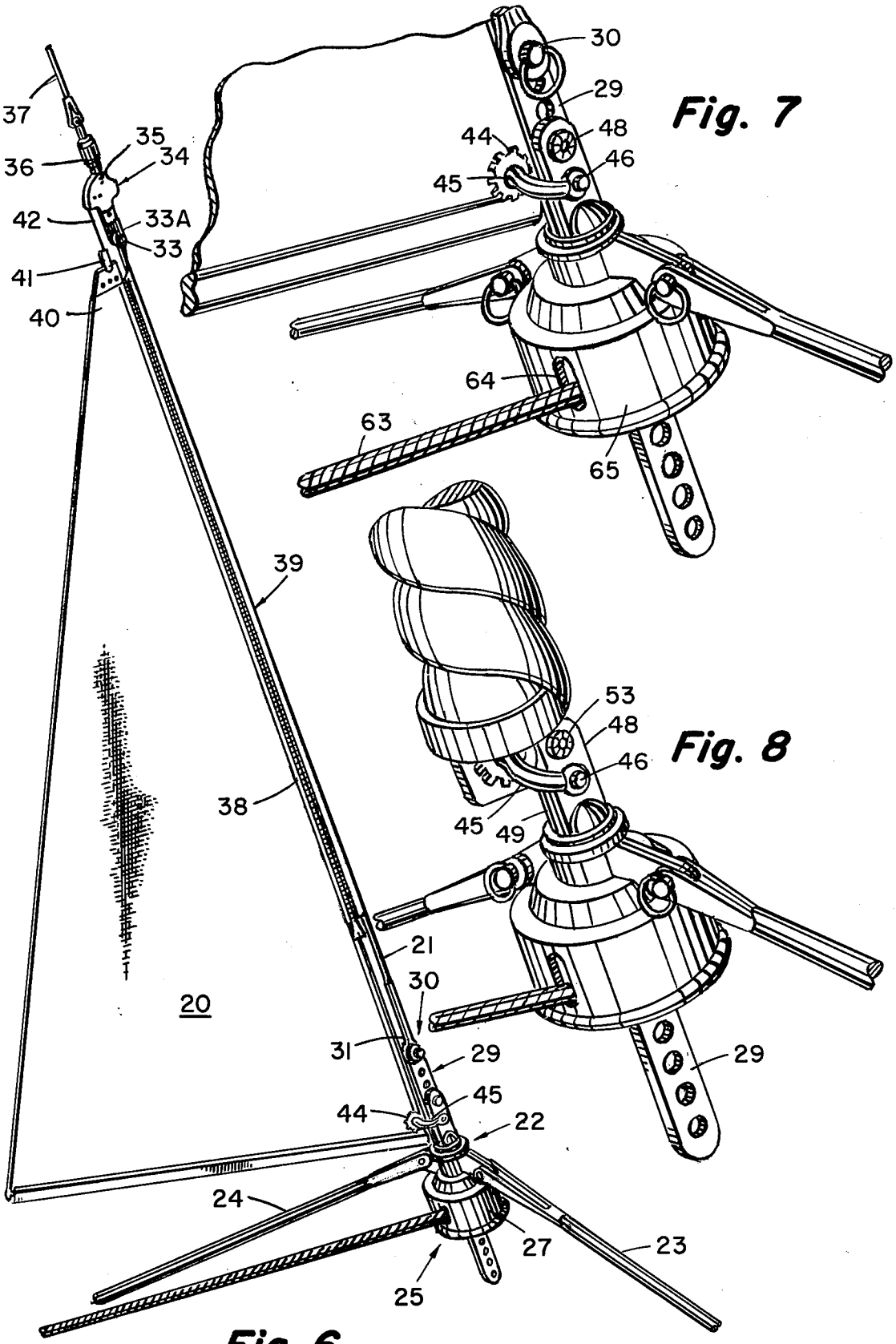
FIG. 6 is a perspective view of the unfurled jib, together with the hoisting apparatus and furling mechanism, taken from the right side of the jib and to the rear of the bridle wires.
FIGS. 7 and 8 are close-up perspective views of the furling mechanism with the jib respectively in the unfurled and furled positions, taken from approximately the same perspective as in FIG. 6.

Referring now to FIG. 6, the structure which permits mounting of the furling mechanism 25 beneath the bridle junction 22 is seen more clearly. It includes a housing assembly generally designated 27 and before describing the structure of the housing assembly 27 in detail, its principal functions will be discussed. One of the functions of the housing assembly 27 is to telescopically receive a forestay adjuster 29, which is secured by means of a pin 30 to a jaw 31 attached to the bottom of the forestay 21. The top of the forestay 21 is attached by a pin 33 to a first swivel connector 33A, the top of which is connected to the bottom of a jib halyard block 34. The top of the block 34 is connected by means of a pin 35 to a second swivel 36, the top of which is connected to the mast by means of a headstay 37.

The jib 20 has a leading edge or luff 38 which is provided with a zippered sleeve generally designated 39. The forestay 21 passes through the zippered sleeve 39 on the luff of the jib. The head of the jib, designated 40 is attached by means of a connector 41 to a jib halyard 42 which passes over the block 34 and is routed through the zippered sleeve 39. The jib is held in the raised position by tying the bottom, free end of the jib halyard about the jib tack shackle after the jib is raised. This is not illustrated in the drawing for clarity. The front of the foot of the jib 20 is provided with a grommet 44 through which a shackle 45 passes for securing the jib to the housing assembly 27, as best seen in FIGS. 7 and 8.

Referring now to FIGS. 7 and 8, a pin 46 passes through the shackle 45, and also through aligned apertures in the stay adjuster 29 and a pair of spaced tabs 48, 49 adapted to receive the stay adjuster 29.

Figure 5:
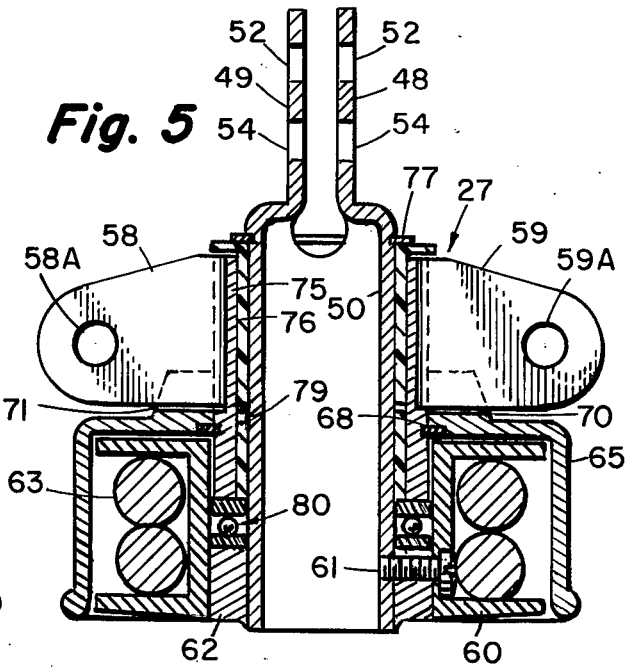
FIG. 5 is a vertical cross sectional view taken through the sight line 5—5 of the housing assembly of FIG. 4.

Referring now to FIG. 5, the tabs 48, 49 are seen to be formed as flat extensions of a tubular element 50 extending through the center of the housing assembly 27 and adapted to telescopically receive the stay adjuster 29. Torque is transmitted to the forestay because the stay adjuster 29 is flat and received between the flat, spaced tabs 48, 49.

The tabs 48, 49 are provided with a first pair of aligned apertures 52 for receiving a pin 53 (see FIG. 8) in securing the housing assembly 27 to the stay adjuster 29. A second pair of similarly aligned apertures 54 receives the previously described pin 46.

Figure 2:
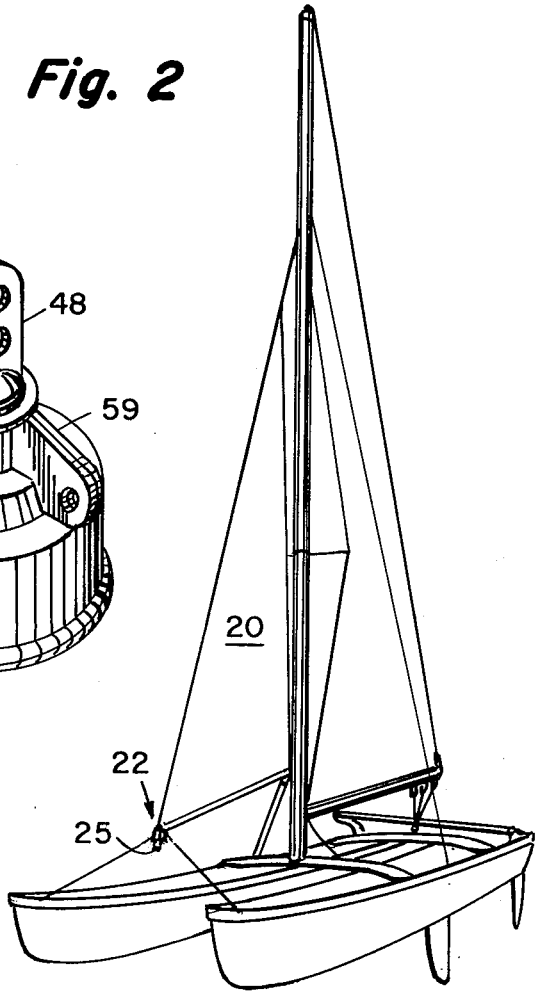
FIG. 2 is a view similar to FIG. 1 with the jib unfurled for use.
Figure 4:
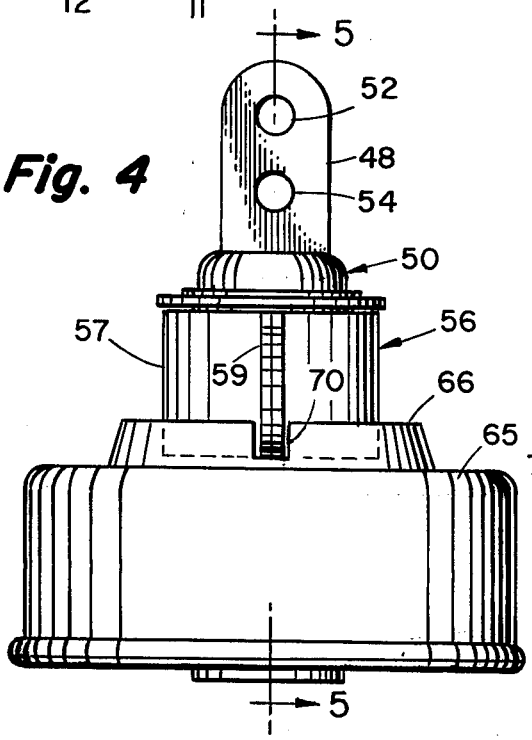
FIG. 4 is a side elevational view of a housing assembly oF FIG. 3.

Referring now to FIGS. 2 and 4, a solid yoke generally designated 56 includes a tubular neck 57 and integral side ears or dogs 58, 59. The yoke 56, by provision of the ears 58, 59 forms a solid link for joining the adjacent ends of the bridle wires 23, 24 which are pinned respectively to the ears 59, 58 through the apertures 59A and 58A.

A drum 60 is secured to the bottom of the tubular assembly 50 by means of a screw 61 which extends through an annular spacer 62 interposed between the tubular assembly 50 and the drum 60. A line 63 is wound around the drum and secured to it for turning it. Turning of the drum, of course turns the tubular assembly 50, the tabs 48, 49, the stay adjuster 29 and the forestay in unison. Referring now to FIG. 7, the line 63 extends through an elongated opening 64 in a housing element 65 with surrounds the drum 60.

As seen in FIGS. 4 and 5, the housing element 65 includes a raised ridge 66 which is held to the yoke 56 by means of a retainer ring 68 (FIG. 5). The raised ridge 66 is slotted on either side as at 70 and 71. These slots receive the ears or link elements of the yoke (see FIGS. 4 and 5), and thereby prevent rotation of the housing element 65 relative to the yoke 56.

The central opening of the yoke 56 is provided with a sleeve bearing 75; and a flanged liner 76 of low friction material such as nylon is interposed between the tube 50 and the bearing 75. A retainer ring 77 holds the tube 50 inside the yoke 56 and sleeve 75. An annular sleeve bearing 79 is also placed around the tube 50 beneath the liner 76 and immediately inward of the sleeve bearing. A thrust bearing 80 is interposed beteen the spacer 62 and the sleeve bearing 75.

OPERATION

With the mast in a generally upright position, the stay adjuster 29 is positioned relative to the housing assembly 27 to achieve a desired mast rake, and when this is achieved, the clevis pin 53 secures the stay adjuster to the tabs 48, 49 of the tubular assembly 50. The shackle 45 is then secured to the housing assembly and the stay adjuster 29 by means of the pin 46. This adjustment is ordinarily made on initial raising of the mast, and need be made thereafter only to adjust mast rake. The mast is secured and positioned by conventional shrouds secured to the hulls behind the forward cross bar.

To raise the jib, the jib halyard 42 is entrained over the pulley in the block 34 and pulled, thereby raising the head of the jib, and causing the sleeve 39 to slide upwardly along the forestay 21. The jib halyard is preferably routed through the zippered sleeve and tied to the shackle 45.

To furl the jib, the line 63 is pulled, thereby rotating the drum 60, tubular assembly 50 and the forestay 21, as described above. As the jib is furled, the forestay 21 has a tendency to twist under the torque applied in furling because it is a wire. Hence, the top of the forestay will lag the motion of the bottom, and the swivel 33A is considered an important feature because it permits the forestay to twist along its length independently of the jib luff and the jib halyard block 34 which is twisted under action of the head of the jib. The halyard block may also twist independently of the headstay 37 due to the swivel 36. The jib is unfurled by means of a jib sheet line and block connected to the tack of the jib.

It will thus be appreciated that the forward portion of the foot of the jib is connected to the mainstay immediately adjacent the bridle junction (see FIGS. 7 and 8). This is facilitated by placing the furling mechanism beneath the bridle junction, and by providing an integral link (comprising the yoke 56 and ears 58, 59) joining the bridle wires. At the same time, the housing assembly includes a central opening for telescopically receiving a stay adjuster to vary mast rake.

Having thus described in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. Apparatus for furling the jib of a catamaran sailboat having a forestay supporting the luff of the jib and connected at an upper end by a swivel connection to a mast of the sailboat, said forestay being attached at its lower end to first and second hulls of said sailboat by means of first and second bridle wires respectively, the improvement comprising: a housing means including link means joining said bridle wires together to form a bridle junction; roller means rotatably mounted in said housing means beneath said bridle junction; torque-transmitting connection means for connecting said roller means to the lower end of said forestay; and means for rotating said roller means to thereby turn said forestay and furl said jib.

2. The apparatus of claim 1 wherein said housing means defines a central aperture generally coaxial with said forestay and wherein said connection means comprises an adjusting member connected to the bottom of said forestay and received in said central aperture of said housing means.

3. The apparatus of claim 2 wherein said connection means comprises a tubular assembly defining first and second laterally spaced, generally flat extensions for telescopically receiving said adjusting member, said adjusting member comprising an elongated, flat plate.

4. The apparatus of claim 3 further comprising a block and pulley; a first swivel connecting said block to the top of said forestay; a jib halyard connected to the head of said jib and entrained about said pulley; means for slidably, loosely attaching the luff of said jib to said forestay and for receiving said jib halyard; a second swivel connected to the top of said block; and a headstay connecting said second swivel to said mast.

5. The apparatus of claim 1 wherein said link means comprises a yoke including a neck connected to said housing and integral, laterally extending ears connected respectively to said bridle wires.

6. The apparatus of claim 1 further comprising a line having one end connected to said roller means and wound thereon, said housing assembly defining a generally cylindrical said wall including an aperture, said line extending through said aperture of said side wall toward said mast, whereby an occupant of said boat may furl said jib by pulling said line.

7. The apparatus of claim 1 wherein said housing assembly defines a central aperture coaxial with said forestay, and wherein said connection means comprises a tubular assembly in said central opening of said housing assembly and connected to said roller means, said tubular assembly extending above said link means and defining first and second flat, spaced extensions, said apparatus further including a flat, elongated adjuster plate connected to the bottom of said forestay and telescopically received in said tubular assembly; and pin means for connecting said adjuster plate to said first and second extensions of said tubular assembly.

8. Jib furling apparatus for a catamaran sailboat having first and second hulls, a mast and a jib sail, comprising: a forestay having a top and a bottom; a block and pulley, first swivel connection means for connecting said block to the top of said forestay; second swivel connection means for connecting said block to said mast while permitting said block to rotate; means for slidingly connecting the luff of said jib to said forestay to permit said jib to be lowered without detaching said forestay; a jib halyard connected to the head of the jib and extending over said pulley and through said luff connecting means; an apertured stay adjuster connected to the bottom of said forestay; a housing assembly telescopically receiving said stay adjuster; a drum rotatably mounted in said housing assembly; torque-transmitting connection means connecting said drum to said stay adjuster while permitting connection therebetween at different, adjusted positions; means for rotating said drum; rigid link means integral with said housing assembly and extending laterally thereof above said drum to form first and second side ears; and first and second bridle wires interconnecting said first and second ears of said link means respectively with the foward portions of said first and second hulls.

* * * * *

UNITED STATES PATENT AND TRADEMARK OFFICE

CERTIFICATE OF CORRECTION

PATENT NO. : 4,080,917
DATED : March 28, 1978

INVENTOR(S) : Hobart Laidlaw Alter et al

It is certified that error appears in the above-identified patent and that said Letters Patent are hereby corrected as shown below:

In column 5, line 19, "said", first occurrence, should be --side--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*